US005988303A

United States Patent [19]

Arfele

[11] Patent Number: 5,988,303

[45] Date of Patent: Nov. 23, 1999

[54] GAUGE FACE INLAY FOR BIT HARDFACING

[75] Inventor: Robert W. Arfele, Houston, Tex.

[73] Assignee: Dresser Industries, Inc., Dallas, Tex.

[21] Appl. No.: 09/167,257

[22] Filed: Oct. 6, 1998

Related U.S. Application Data

[62] Division of application No. 08/747,548, Nov. 12, 1996.

[51] Int. Cl.[6] ..... E21B 10/16; B21K 5/04

[52] U.S. Cl. ..... 175/374; 76/108.2

[58] Field of Search ..... 175/353, 336, 175/413, 428, 426, 374, 378, 434, 431; 76/108.2, DIG. 11, DIG. 12

[56] References Cited

U.S. PATENT DOCUMENTS

| | | | |
|---|---|---|---|
| 4,368,788 | 1/1983 | Drake | 175/374 |
| 4,398,952 | 8/1983 | Drake | 419/18 |
| 4,423,646 | 1/1984 | Bernhardt . | |
| 4,499,795 | 2/1985 | Radtke . | |
| 4,499,958 | 2/1985 | Radtke et al. . | |
| 4,660,623 | 4/1987 | Ashton . | |
| 4,884,477 | 12/1989 | Smith et al. . | |
| 4,888,082 | 12/1989 | Fetcenko et al. . | |
| 5,197,527 | 3/1993 | Namba et al. . | |
| 5,247,984 | 9/1993 | Stanciu . | |
| 5,333,699 | 8/1994 | Thigpen et al. . | |
| 5,373,907 | 12/1994 | Weaver | 175/426 |
| 5,433,280 | 7/1995 | Smith . | |
| 5,516,053 | 5/1996 | Hannu . | |
| 5,544,550 | 8/1996 | Smith . | |

*Primary Examiner*—Frank Tsay
*Attorney, Agent, or Firm*—Browning Bushman

[57] ABSTRACT

Steel bit bodies are manufactured in a production process that employs polystyrene patterns in a lost foam casting process. The patterns are machined to permit the formation of complex shapes that cannot be reproduced in simple patterns that are extractable from reusable, two-piece pattern molds or dies. The patterns are machined from a billet material according to a basic, programmed, five-axis machining process to form multiple copies of a reproducible complex pattern body. The process is modified to produce multiple copies of a modified design. Machining the complex patterns and producing variations by changing the machine program permit multiple bit patterns of variable forms to be produced without need for building an intermediate, reusable pattern mold that would require multiple mold pieces, thus eliminating the associated time and expense required in the creation of a new pattern mold for each variation of the bit design. The pattern is machined in a single chucking operation in a machine tool adapted for machining plastics in a three-dimensional global process. The plastic has a composition and a density that permit it to be machined into a pattern having relatively small, unsupported structural projections and smooth surface features. Bit patterns formed in the process have forward canted blades that are machined from mating planar surfaces to simplify the machining process. The edges of the forward canted blades form a spiral surface for mounting cutter elements. The forward canting makes the blades stronger and thus permits the blades to be thinner than non-canted blades to increase the clearance between blades, which improves the movement of cuttings past the bit. Recesses are machined into the gauge face of the patterns to produce a recess in the casting for receiving hardfacing. The hardfacing in the recess forms a layer that cooperates with the surrounding blade material to form a smooth transition area as the bit wears during usage.

5 Claims, 3 Drawing Sheets

FIG. 2
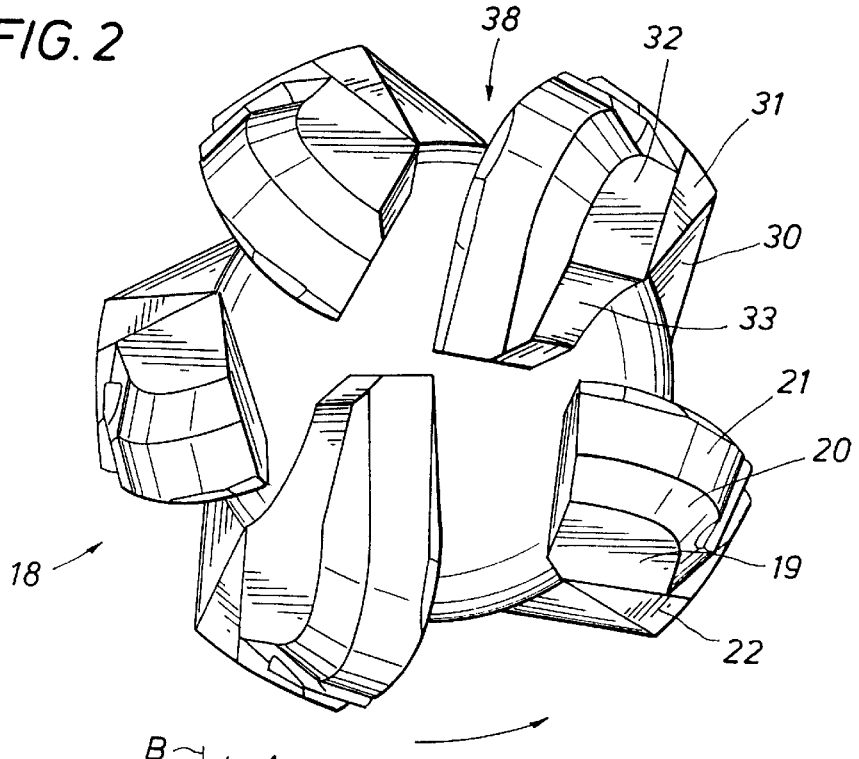
FIG. 3
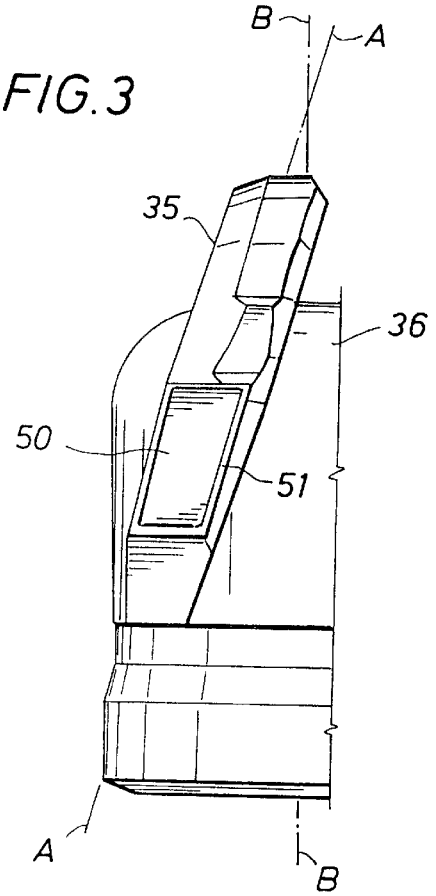
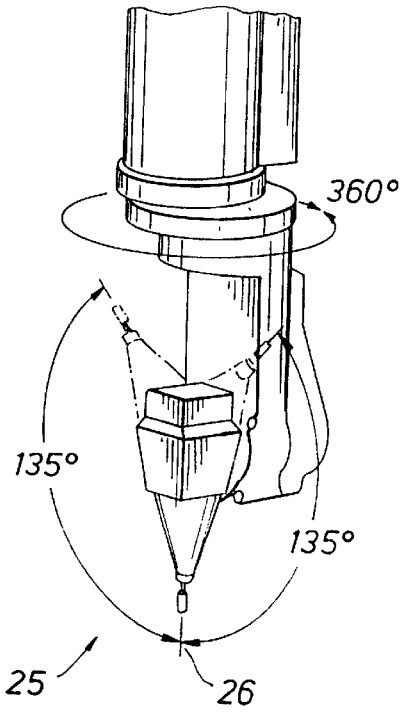
FIG. 6

GAUGE FACE INLAY FOR BIT HARDFACING

This application is a divisional of U.S. Patent Application Ser. No. 08/747,548, filed Nov. 12, 1996.

BACKGROUND OF THE INVENTION

1. Field of the Invention

The present invention relates generally to the manufacture of steel-bodied bits used in the drilling of oil and gas wells. More specifically, the present invention relates to bit designs and to processes for casting bits having complex configurations, in different sizes and with modified configurations, without the use of complex, reusable pattern molds.

2. Description of the Prior Art

A basic process for manufacturing a steel bit is to machine the bit from a solid billet of steel into the desired final bit form. The basic process is improved upon by using a steel casting that has already been cast into a form approximating the final bit form, permitting a substantial reduction in machining. The procedure is complicated by the addition of the metal casting step, but the overall savings in time and cost are more than offset by the use of castings.

It is common to cast the bit body with excessive material to permit the machining of alternative design features in a particular bit. In these situations, the superfluous material that is left on the casting to provide the option of including a particular feature is machined off if the bit is to be manufactured without the additional feature. The inherent trade-off is that the more universal a casting becomes, the greater the additional machining required to remove the extra material in the casting when a bit not employing the additional feature or features is to be manufactured. This problem may be overcome to a degree by employing a specialized casting that closely resembles the final form of only a specific model bit. However, a trade-off is again necessary because the specific casting cannot be machined to include features that would be created in material not present in the casting. In normal production, a compromise is made between the flexibility allowed by machining a casting into several different end forms and the cost of having a special casting made for each of the different design forms.

In the field of bit manufacture, it is common to require relatively specialized bit sizes, shapes, and designs to meet a particular application. Frequently, the bit is built to a customer's specific requirement. The greater the diversity of design and size requirements of the particular bit, the more closely the universal casting resembles a basic steel billet. In the past, there has been a constant need to compromise between increasing efficiency and reducing the cost of production runs of a specific bit design and maintaining the capability of providing a variation in the bit size or bit design for a relatively small production run or even a single custom-made bit design.

It is known in the field of metal casting that a relatively complex physical configuration may be cast in a process in which the mold is sacrificed with each casting. One such process, referred to generally as a "lost foam" process, employs an expendable plastic pattern in an expendable mold. In a variation of this process, foam patterns are produced in a reusable metal mold or die where large numbers of identical objects are to be cast using a lost foam process. Each of the patterns produced in the die may be used in a process in which the plastic pattern is covered with a hardenable fluid material to form a shell mold. The materials and steps used in a specific process of this type are more fully described in U.S. Pat. No. 4,660,623. Once the shell mold has hardened, the foam pattern is removed through a chemical or heating process. The hardened shell is then filled with molten steel to produce the casting. Once cooled, the shell mold is broken away from the casting. The step of sacrificing a plastic pattern and an expendable shell mold is repeated for each of the metal castings.

The described lost foam procedure typically follows a multistep process, the first of which is to fabricate a positive model of the object to be cast. This model is then employed to form a reusable metal negative pattern mold or die. Depending on the complexity of the pattern to be produced by the pattern mold, the pattern mold may require multiple separable components to provide a mold that can be released from the pattern. Once the pattern mold is completed, large numbers of patterns may be produced using the mold. Any change in the design of the object to be cast requires a change in the pattern mold.

The construction of a metal pattern mold for a complex shape, such as a drill bit having a complex form that cannot be removed from a two-piece mold is time-consuming and expensive. In a typical situation that requires the building of a pattern mold for a steel-bodied bit design, fabrication of a suitable metal mold for the foam pattern may require several weeks and may cost as much as $50,000 or more. Any variation in the bit design requires a modification or fabrication of a new pattern mold with an associated time loss and expense. Accordingly, the usual procedure of employing an intermediate metal pattern mold to provide the foam patterns used in the lost foam casting process is undesirable for use in the fabrication of complex steel-bodied bits.

U.S. Pat. No. 5,197,527 describes a process in which a foam block workpiece is machined into a lost foam pattern for use in a full mold casting. The system is directed toward a process in which multiple machining stations are employed so that optimum efficiency is realized in a process where a large number of identical patterns are being fabricated. The patented procedure describes a rectilinear, three-axis machine that is positioned below the workpiece to shape the surface of the workpiece in machine movements along the three standard, mutually perpendicular axes. While the work pieces are being machined, it may be appreciated that the system could be improved with the use of cast patterns since the patterns produced in the described machining process are also appropriate for use in an intermediate pattern molding process. This observation results from the fact that patterns formed using only three-axis movement have non-complex configurations that allow them to be extracted from relatively simple two-piece molds. Variations in simple, non-complex designs of the type illustrated in the prior art process can also be easily achieved by simple modifications to the pattern mold. The described patented system is also well suited for a process in which a large number of identical items are to be cast.

U.S. Pat. No. 4,423,646 describes a process for producing a rotary drill bit in which a casting technique using a plastic foam is used to produce steel bit bodies. Foam is molded in a shape substantially identical to that of the drill bit body, and cutting members are mounted on the foam form. The foam form may be machined to produce additional bit features. The assembly is then coated with a hardenable mold material to form a mold body. The foam is burned out of the hardened mold to leave a mold cavity, and molten steel is poured into the mold cavity. After the steel has cooled, the mold is removed from the completed bit by a chemical treatment. Production of the desired foam pattern is thus seen to require a two-step process, including molding and machining.

While it is recognized that a complex pattern that may not be easily molded may be machined from a block of pattern material, the limitations of a machining process are brought to each pattern made in the process. Machining a pattern, rather than molding it in a complex die or mold, does not eliminate the problems of cost and time expenditures.

The machining of patterns permits any desired number of identical patterns to be fabricated by a properly programmed numerically controlled machine. However, as with any machining program, the greater the complexity of the machined part, the greater the time and expense required to fabricate the part. Curved parts are particularly time-consuming since they typically require a large number of machining passes to create a smooth curvature.

Conventional spiral blade drill bits have a continuously curving blade end that is used to mount cutting elements in a spiral configuration. Machining the curved, spiral blades into a steel casting is very difficult and time-consuming. Machining plastic into the curved shapes is also time-consuming and, because each pattern must be separately fabricated, the time loss for a production run is multiplied by the number of patterns being machined. Accordingly, any design change that reduces the machining complexity can provide significant time and cost savings, whether it be for steel or plastic.

The machining of plastic patterns also makes possible the creation of bit designs that would not be practical if the design were to be machined from steel castings. Thus, a surface that might require an hour to form on a steel bit body may require only a few minutes to machine onto a plastic pattern. This capability can make practical the creation of cast bit features that would be impractical if they were to be machined directly on the steel bit.

One problem encountered in the typical fabrication of a steel-bodied bit derives from the welded-on application of hardfacing to the gauge faces of the bit. If the material is not properly applied, it may make the bit over- or undersized, or it may create rough edges that grab the face of the wellbore. In either case, the bit must be reworked to correct the defect.

Conventional steel bits also employ a layer of hardfacing that extends from blade edge to blade edge across the face of the blade. If the hardfacing is not properly applied, the hardfacing layer may form a sharp edge as the bit body wears away from its contact with the harder hardfacing material. The resulting edge of hardfacing material can gauge the wellbore wall and create bit vibration and other undesired drilling actions. Accordingly, it will be appreciated that the proper application of hardfacing to the correct area of the bit can be critically important to proper bit operation.

BRIEF DESCRIPTION OF THE INVENTION

The present invention provides a process for the manufacture of complex steel bodies having a configuration that cannot be cast in a two-piece reusable mold. The invention also provides a novel bit design that may be made using the process of the invention. In the process of the invention, a pattern is machined from a block of plastic material to form a first, reproducible complex pattern body. In this context, the term "complex pattern" is intended to describe a pattern that cannot be extracted from a reusable mold that is formed from fewer than three pieces. The complex pattern body is employed as the lost material in a lost material casting process to form a metal replica of the first complex pattern body. The metal castings made from the machined complex pattern may be made in multiples of two or more by simply repeating the same machining process for each pattern. An important feature of the present invention is that the process of manufacturing a variant of the complex pattern body may be effected by simply changing the machining control program to produce a variant machined pattern. This capability permits the limited production of multiple units of a given, complex bit pattern design, as well as modifications of the design without the intermediate steps of fabricating a reusable pattern mold and modifying the pattern mold to produce the modified patterns.

In the preferred form of the process, the complex pattern is machined from an extruded polystyrene material. A five-axis, numerically controlled machining tool is employed to form the complex bit pattern body. Multiple copies of a given body design are produced using the basic core program. Multiple copies of one or more modified forms of the bit design are produced by modifying the basic core program.

The machined complex bit patterns may be used in the "Replicast" process or other similar process in which a hardenable material is used to coat the polystyrene pattern to form a thin shell mold. The coated pattern is heated to harden the coating and burn away or vaporize the pattern. The resulting shell mold, which is preferably ceramic, is placed in a supporting sand bed or other support structure and filled with molten steel to create the desired bit body. Once the metal has cooled, the ceramic shell mold is broken away from the metal to expose a bit having the desired complex form.

The plastic material employed for the machine billet is preferably a lightweight, extruded polystyrene that may be machined to a relatively smooth surface. This material, in addition to being capable of being machined to a smooth surface, is also sufficiently strong to permit elongate, relatively small, self-supporting features to be machined into the pattern. The plastic commonly used in die casting or molding patterns is typically more granular, less dense, and structurally weaker than the preferred material such as the extruded polystyrene employed in the present invention.

The plastic material billet is machined to a complex shape in a one-step machining operation that eliminates the requirement for rechucking the workpiece, adding to the precise repeatability of the machined pattern. The use of a four- or five-axis machine also eliminates the requirement for placing a central mounting mandrel or other chucking fixture in the plastic billet as might otherwise be required for repositioning the workpiece in a conventional three-axis machine for the formation of complex machined features.

A special-purpose five-axis machine designed to machine soft materials, such as wood or plastic, is used to permit increased machine speed and flexibility. The special-purpose machine is particularly useful in fabricating complex bit pattern surfaces for use in production runs that require relatively frequent changes in bit pattern design.

The bit of the present invention has independent features resulting inherently from its design, as well as from its method of fabrication. The bit of the present invention is a spiral blade steel body bit that has increased spacing between adjacent blades to increase the bypass of cuttings as the bit is drilling. The bit blades are canted relative to the bit axis and are formed in flat surfaces that combine to produce the effect of a continuous spiral curve along the blade edges for mounting cutting elements. By this means, the effect of a spiraling, curved machine surface is obtained from a simpler flat surface machine process.

Another feature of the forward canting of the blades in the bit of the present invention is that the drilling forces acting on the rotating blades are directed largely from the blade edge, through the blade to the bit body. By contrast, the drilling forces on a non-canted blade are directed at right angles against the blade face, which increases the forces tending to bend the blade back. Application of forces to the blade edge, rather than to the side of the blade, permits the blade thickness to be reduced. Reduction in the blade thickness contributes to the spacing between blades, which in turn improves the flow of cuttings past the bit.

Another feature of the bit of the present invention is the provision of recessed areas on the gauge face for the application of hardfacing material. A recessed area is machined into the gauge face area of the plastic mold. The casting of the bit contains the corresponding recess. Hardfacing material applied to the recessed area functions to resist wear as the bit is rotated to help maintain a constant bore diameter. The recessing of an area between the blade edges for the application of the hardfacing contributes to a smooth contact surface between the bit blade material and the hardfacing material, which prevents the edge of the hardfacing material from gouging the formation wall or being broken away from the blade. The recess also serves as a marker for the welder applying the hardfacing material, resulting in a more uniform, complete application of the hardfacing layer. While the formation of recessed areas in the steel bit itself requires a time-consuming machining process, the recess may be quickly and easily machined into the plastic pattern employed in the casting process used with the present invention.

From the foregoing, it will be appreciated that an important object of the present invention is to provide a process in which multiple complex steel bit bodies may be cast from patterns created by a programmable machine using a lost foam casting process.

Another important feature of the present invention is the provision of a process for changing a basic bit design by changing the core program for controlling a computerized machine tool.

Yet another object of the present invention is to provide a means for making multiple identical metal replicas of a basic bit design, modifying the design easily and quickly and making multiple identical replicas of the modified design.

Another object of the present invention is to provide a process in which the complex foam pattern employed to produce bit castings may be inspected in its final form substantially exactly approximating the complex bit body to be cast, thereby permitting easy detection of defects in the pattern body. As compared with other processes wherein the final bit pattern is created through a series of steps that produces a pattern having only a vague resemblance to the final desired form, the system of the present invention permits relatively inexperienced inspectors to detect defects because of the direct comparison possible between the end product and the pattern.

An important object of the present invention is to provide a process for casting drill bits in which relatively small numbers of a specific design of a drill bit may be manufactured and modifications of the basic design may be manufactured without additional expense and time delay.

An object of the invention is to provide a production process for forming multiple complex metal bit bodies from plastic patterns machined by a computer-controlled machine tool to produce readily repeatable and readily modifiable plastic pattern replicas of a complex bit body.

Yet another object of the present invention is to provide a process for casting metal bits in which a pattern material is machined to form the lost material pattern in a lost material casting process with such lost material having a consistency that may be easily machined to produce a smooth, durable pattern in a substantially exact replica of a desired bit design.

It is an object of the present invention to provide a process for manufacturing complex bits that may be economically produced in relatively small quantities and in which variations in the bit design may be made by changing the programming in a numerically controlled machine.

Another object of the present invention is to provide a process in which a machine tool having four or more axes forms a complex plastic pattern in a single chucking operation whereby multiple exact replicas of the desired bit configuration can be cast in a lost material casting process.

A related object of the present invention is to provide a process for machining soft materials in a five-axis machine whereby relatively small numbers of a specific design can be fabricated economically.

Another important object of the present invention is to provide a bit having specially configured blades that cant forward on the bit body to provide a spiral edge pattern for the mounting of cutter elements.

A related object of the present invention is to provide a steel-bodied bit having forward canted blades that are formed from planar machined surfaces cooperating with each other to provide a spiral cutter mounting configuration that functions like that of a continuously curved spiral blade design.

It is also an object of the present invention to provide a bit in which bit blades are canted forward in the direction of bit rotation so that the bit blade edges engage the formation at an angle to direct the drilling forces lengthwise through the blade toward the bit body to increase the strength of the blade in the drilling direction.

It is an object of the present invention to provide a process in which the patterns employed for making a multiblade, steel-bodied bit is accomplished by machining planar surfaces on a plastic pattern that cooperate with each other to provide the effect of a spiral blade.

It is a general object of the present invention to provide a bit design that has simplified machining surface features that produce effects similar to those obtained with more complex machine surfaces.

It is an object of the present invention to employ a pattern having improved machining characteristics of the type described for use in a lost material casting process.

Another object of the present invention is to provide a bit design that can be cast from plastic patterns having characteristics that are more easily machined into plastic than steel.

A related object of the present invention is to provide a bit having a recessed area for the application of hardfacing material to the gauge face of the bit.

It is a related object of the present invention to provide a pattern having the recessed area for the application of hardfacing material being machined into the gauge face of the plastic pattern employed in producing a bit using a lost foam casting process.

The foregoing objects, features, and advantages of the present invention will be more fully appreciated and understood from the following drawings, specification, and claims.

BRIEF DESCRIPTION OF THE DRAWINGS

FIG. 2 is an end view of a bit pattern of the present invention;

FIG. 3 is an elevation of a section of the bit pattern of the present invention;

FIG. 6 is an elevation of the machine head of a five-axis CNC machine employed for fabricating the patterns employed in the process of the present invention.

DESCRIPTION OF THE PREFERRED EMBODIMENTS

Figure 1:
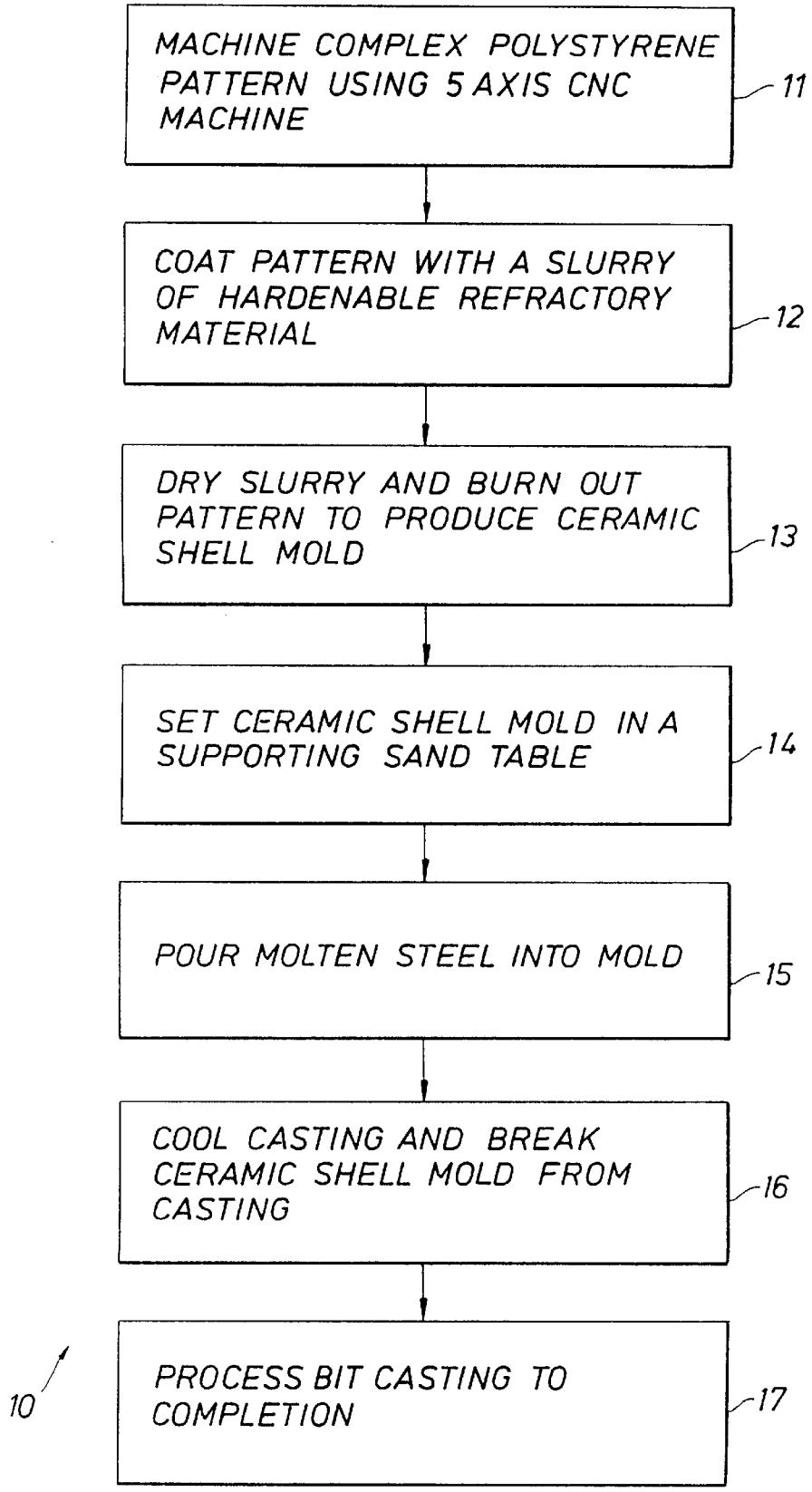
FIG. 1 is a block diagram describing the steps of manufacturing the steel-bodied bit of the present invention.

The basic steps in the process of the present invention are indicated generally at 10 in FIG. 1 of the drawings. The first step of the process requires the machining of a billet of an extruded polystyrene to form a complex pattern that is substantially identical to the bit to be manufactured in the casting process. The pattern is machined using a five-axis computer operated, numerically controlled machine that is capable of machining a complex form in a single chucking of the plastic billet.

As indicated in block 12, the machined pattern is coated with a slurry of hardenable, refractory material. The coated plastic pattern is placed in a dryer, as indicated at block 13, to harden the refractory material to a ceramic shell and simultaneously burn out the plastic pattern.

The ceramic shell mold is positioned in a sand table, as indicated at block 14, to provide structural support to the thin ceramic shell.

Molten steel is poured into the ceramic shell mold, as indicated at block 15.

When the steel has cooled, the ceramic shell molding is broken away from the resulting casting, as indicated in block 16.

The casting is subsequently machined or otherwise processed to complete the bit formation, as indicated in block 17.

The steps indicated in blocks 12–17 are well known in the prior art. The procedure for forming the mold pattern and the specific bits produced in the process, as well as the bit designs, regardless of their manner of production, are the subject of the present invention. In the process of the present invention, a production system is established in which a program for a particular complex bit design is created, a limited number of patterns are machined using the design, and the program is changed to made a modified bit design. The modified design is run for a limited time and is again modified to produce one or more patterns of the second modified design. This system is thus distinguished from one in which an intermediate pattern mold is fabricated or modified for each new or different bit run.

FIG. 2 illustrates the end of a polystyrene billet that has been machined into a five-bladed bit pattern. The pattern, indicated generally at 18, is "complex" in that it has a configuration that prevents it from being extracted from a simple, reusable two-piece mold structure. While it is possible to construct a mold that can be used to mold the pattern 18, such a mold would require such a large number of separate components and complex arrangements that the cost and time required for constructing such as mold would made the process prohibitive.

A feature of the present invention is the design of a bit in which the pattern 18 may be machined in a series of connecting planar surfaces, such as the surfaces 19, 20, 21, and 22, which connect together to give a desired surface con figuration to the pattern. The significance of forming the bit features in planar surfaces is that it substantially reduces the time required to machine the surface as compared with the time required for machining a feature comprised of curved surfaces. This advantage extends to the process of machining the plastic pattern, as well as machining the bit body from a steel billet.

The pattern 18 is machined from a solid billet of extruded polystyrene. The billet is positioned in a five-axis computerized, numerically controlled machine that is especially adapted for processing plastic. The machine, which is illustrated partially in FIG. 6, has three axes of rectilinear motion, and two axes of rotational movement. The machine head, indicated generally at 25 in FIG. 6, includes a machine tool 26 that can be rotated from the vertical through an arc of 135° on either side of the tool centerline. The head mounting has a 360° rotational movement, as indicated in FIG. 6. The combination of the three rectilinear axes and two rotational axes permit the machine 25 to create a global, complex pattern without having to rechuck the workpiece. This capability is significant since the tolerances required in the relatively soft plastic pattern are difficult to maintain and can be exceeded if the workpiece must be repositioned in the chuck. The same problem exists if the workpiece is centered on a central mandrel with the mandrel being reset in the machine as required to permit a machine tool with a limited range of movements to machine the required complex surface features on the pattern.

An important feature of the design of the bit pattern of the present invention is illustrated by reference to FIG. 2 in which it is noted that the rear blade face as defined by the planar surfaces 30, 31, 32, and 33 provides the effect of a curved spiral blade surface without the requirement for the more time-consuming process of machining curved surfaces. The front surface of the blade (not visible) is similarly constructed of contacting planar surfaces to provide a blade that performs functionally the same as a smoothly curved spiral blade. Where possible, the surfaces of the external features of the bit pattern 18 are machined in a series of contacting planar surfaces to reduce the machining time required to form the pattern.

An important feature of the present invention is illustrated with reference to FIG. 3 in which a pattern bit blade 35 is illustrated extending from the body 36 of the bit pattern. The plane of the bit blade 35 extends generally along the line A—A, while the central axis of the bit body extends generally along the line B—B. As may be seen by reference to FIG. 3, the plane of the blade 35 intersects the axis B—B of the bit pattern at an angle. As employed herein, this position of the blade relative to the pattern axis is referred to as a "forward canting" of the blade. Also in this regard, the term "forward" is used relative to the forward rotation of a bit manufactured from the pattern 36. Forward bit rotation is that in which the bit is being employed to drill a wellbore. The forward canting is important to the design of the bit of the present invention in that it positions the blades such that the forces of drilling are directed along the plane of the blade and back to the bit body. In a conventional, non-canted blade mounting, the forces of drilling are applied at right angles to the bit blade, exerting a maximum bending force on the blade itself. Canting of the blade directs the drilling force through the body of the blade back to the body of the bit so that the blade resists the bending force of the drilling motion.

This redirection of drilling forces through the blade body permits a thinner blade to be employed, which in turn increases the spacing between adjacent blades. This spacing, indicated generally at 38 in FIG. 2, is referred to as a "junk slot," which enables formation cuttings being removed by the bit to flow upwardly past the bit and back to the well surface. Increasing the area of the junk slot increases the drilling capability of the bit.

It will also be noted that, in addition to being canted, the blades are tilted in their mounting on the bit body pattern. The term "tilting" refers to a position in which the plane of the blades is angled forward, away from the radial direction, in the direction of forward bit rotation.

Figure 4:
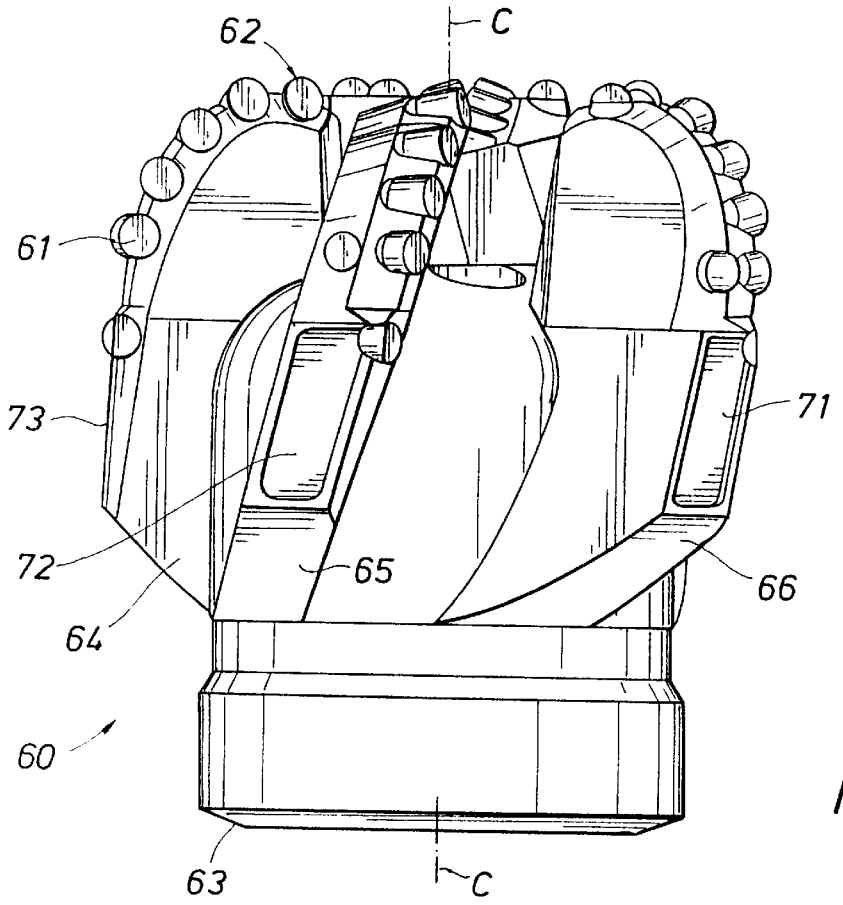
FIG. 4 is an elevation of a bit manufactured in accordance with the teachings of the present invention.
Figure 5:
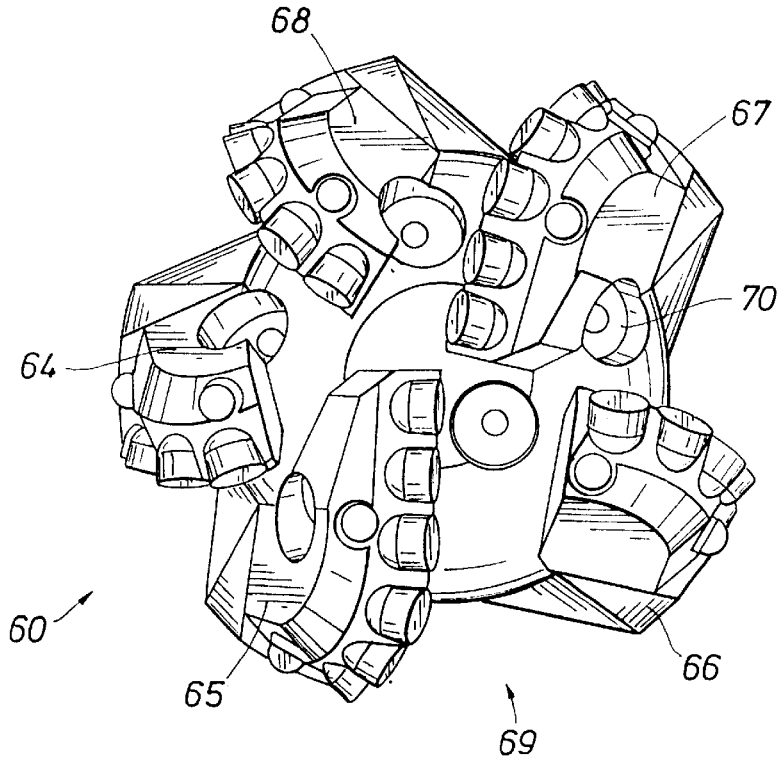
FIG. 5 is an end view of the bit of FIG. 4.

The placement of the blades on the bit body pattern produces a bit design in which the bit cutters may be mounted along the blade edges in a desired spiral pattern. This pattern, which may best be seen by joint reference to FIGS. 4 and 5, is one in which the cutters along the edge of the blade and closest to the axis of bit rotation lead the cutters that are further away from the bit axis, in the direction of forward bit rotation, and the cutters advance away from the bit axis as they become further removed from the bit end. This desired configuration is achieved without the need for machining a support structure that tracks the curved spiral placement of the cutters.

Another important feature of the bit of the present invention is the provision of recessed areas on the external surface of the bit. These recessed areas serve as defined places for the application of hardfacing, which protects the bit body from the effects of erosion and wear. One such area, indicated at 50 in FIG. 3, is provided at the radially outermost edge of the blade 35. The casting formed from the pattern illustrated in FIG. 3 will have a corresponding recessed area in the bit blades. This recessed area is used for the application of hardfacing material that is customarily applied through a welding process. The recessed area has an edge 51 that serves as a gauge for the welder during the application of the refacing material and also forms a transition area between the material of the bit blade and the hardfacing material. These features combine to prevent the formation of rough edges, or over- or undersized layers of hardfacing, that would otherwise produce undesired bit performance.

With reference to FIGS. 4 and 5, there is illustrated a bit that has been manufactured in accordance with the teachings of the present invention and that includes features of bits of the present invention. The bit of FIG. 4 is indicated generally at 60 and includes a series of cutter elements 61 that are in the form of cylindrical inserts with hardfacing. These cutter elements, which are conventional, are secured to the bit blades by braising or another suitable process.

The bit 60 has a bit face 62 at one end and a connection section 63 at its opposite end. The bit body extends axially along an axis C—C and carries blades 64, 65, 66, 67, and 68. The bit includes junk slots, such as the slot 69 included between adjacent blades 65 and 66. Five such junk slots are present in the bit 60. The size of the junk slots 69 is significantly larger than that which could be obtained with a bit design employing thicker blades. Accordingly, the bit produces improved cuttings removal and consequently is able to drill a wellbore more quickly and efficiently. Nozzles 70 positioned in the bit body are directed and disposed to wash debris from the cutter blades.

FIG. 4 illustrates hardfaced gauge areas 71, 72, and 73. These areas are at the outer radial extremities of the bit body and determine the wellbore diameter drilled by the bit.

It may be appreciated that the specific characteristics of a bit having the features described in the present application have independent value and novelty beyond that resulting from the manner in which they were fabricated. Thus, the provision of recessed areas on the surfaces of a bit for the receipt of hardfacing material has benefit in any seal bit fabrication process. The feature is particularly useful where it can be implemented by machining a relatively soft pattern material to provide the desired form in a subsequent casting. It is also apparent that the benefits derived from machining multiple planar surfaces to achieve the effect of a continuous curved surface are beneficial whether applied to the steel billet employed in machining a bit directly or to the plastic billet employed in machining a pattern for a casting process. Additional importance is attached to the machining process when the machine component is a plastic that is to be used in a casting process.

Similarly, forward canting of the blades on the bit body provides a beneficial effect regardless of the manner in which the blades are formed. In this regard, machining of a bit from a steel billet with forward canted blades produces a bit that is superior to a bit having the same drilling strength, but with thicker blades.

While the preferred pattern material has been described as an extruded polystyrene, it will be appreciated that other materials may be used in the practice of the process of the present invention. Generally, any pattern material that can be easily machined, is sufficiently lightweight, has sufficient structural strength to allow the formation of self-supporting pattern features, and can be used as the pattern for a lost material casting process is suitable.

The five-axis machine employed in the practice of the present invention is particularly preferred in that it is capable of machining the plastic pattern with minimal machine-imposed forces so that the pattern is cut to a close tolerance. However, while a five-axis machine designed for machining plastic is the preferred means for forming the complex patterns of the present invention, it will be appreciated that any four-axis machine that can suitably fabricate the required complex pattern to the required tolerance in a single chucking operation may also be employed.

The foregoing description and examples illustrate selected embodiments of the present invention. In light thereof, variations and modifications will be suggested to one skilled in the art, all of which are in the spirit and purview of this invention.

What is claimed is:

1. A process for manufacturing a steel-bodied bit comprising the steps of:

(a) making a pattern of said bit for use in a bit body casting process;

(b) making an area on said pattern for producing a defined area on a bit body cast in a casting process using said pattern;

(c) casting said bit body in said casting process; and (d) applying hardfacing material to the defined area of said cast bit body.

2. The process as defined in claim 1, further comprising the step of recessing the defined area to form a recessed area on said bit body.

3. The process as defined in claim 2, further comprising the steps of machining said pattern.

4. The process as defined in claim 1 wherein said pattern is made from a plastic material and said casting is made in a mold shaped by said pattern.

5. The process as defined in claim 3 wherein said pattern is made from a machined plastic and said mold is made from a hardenable slurry of refractory material.

* * * * *